US011011845B2

(12) United States Patent
Flood et al.

(10) Patent No.: US 11,011,845 B2
(45) Date of Patent: May 18, 2021

(54) HEARING ASSISTANCE DEVICE INCORPORATING A QUARTER WAVE STUB AS A SOLDERLESS ANTENNA CONNECTION

(71) Applicant: Starkey Laboratories, Inc., Eden Prairie, MN (US)

(72) Inventors: Stephen Paul Flood, Eden Prairie, MN (US); Beau Jay Polinske, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 281 days.

(21) Appl. No.: 15/493,896

(22) Filed: Apr. 21, 2017

(65) Prior Publication Data

US 2018/0310106 A1 Oct. 25, 2018

(51) Int. Cl.

| | |
|---|---|
| ***H01Q 9/04*** | (2006.01) |
| ***H04R 25/00*** | (2006.01) |
| ***H01Q 1/27*** | (2006.01) |

(52) U.S. Cl.

CPC ..... *H01Q 9/0457* (2013.01); *H01Q 1/273* (2013.01); *H04R 25/554* (2013.01); *H04R 25/65* (2013.01); *H04R 2225/51* (2013.01)

(58) Field of Classification Search

CPC ..... H01Q 1/273

See application file for complete search history.

(56) References Cited

U.S. PATENT DOCUMENTS

| | | | | |
|---|---|---|---|---|
| 6,292,153 | B1 * | 9/2001 | Aiello | H01Q 1/36 343/767 |
| 8,878,735 | B2 | 11/2014 | Kvist et al. | |
| 2005/0099341 | A1 | 5/2005 | Zhang et al. | |
| 2011/0300907 | A1 * | 12/2011 | Hill | H01Q 1/243 455/566 |
| 2013/0342407 | A1 | 12/2013 | Kvist et al. | |
| 2013/0343586 | A1 * | 12/2013 | Kvist | H04R 25/554 381/315 |
| 2014/0010393 | A1 | 1/2014 | Kvist | |

(Continued)

FOREIGN PATENT DOCUMENTS

| | | |
|---|---|---|
| EP | 2723101 | 4/2014 |
| EP | 2765650 | 8/2014 |

(Continued)

OTHER PUBLICATIONS

EP Search Report dated Aug. 9, 2018 from EP App. No. 18165980.6, 9 pages.

(Continued)

*Primary Examiner* — Daniel Munoz

(74) *Attorney, Agent, or Firm* — Shumaker & Sieffert, P.A.

(57) ABSTRACT

A hearing assistance device for use by a wearer comprises an enclosure and a substrate comprising a circuit board disposed in the enclosure. An antenna is disposed within or on the enclosure. A feed arm arrangement is coupled to the circuit board. A section of the feed arm arrangement extends over the antenna and establishes a non-contacting electrical coupling with the antenna. The section of the feed arm arrangement extending over the antenna can have an electrical length of approximately one-quarter of a wavelength of a signal transmitted or received by the antenna.

9 Claims, 8 Drawing Sheets

(56) References Cited

U.S. PATENT DOCUMENTS

| | | | | |
|---|---|---|---|---|
| 2014/0226844 | A1 | 8/2014 | Kerselaers | |
| 2015/0146899 | A1 | 5/2015 | Dzarnoski et al. | |
| 2015/0230035 | A1 | 8/2015 | Prechal et al. | |
| 2015/0296312 | A1 | 10/2015 | Nikles et al. | |
| 2016/0050501 | A1* | 2/2016 | Pinto | H01Q 1/273 381/315 |
| 2016/0165366 | A1 | 6/2016 | So et al. | |
| 2016/0295335 | A1* | 10/2016 | Vajha | H01Q 1/36 |
| 2016/0330552 | A1 | 11/2016 | Flood | |

FOREIGN PATENT DOCUMENTS

| | | |
|---|---|---|
| EP | 2985834 | 2/2016 |
| EP | 3094111 | 11/2016 |

OTHER PUBLICATIONS

Examination Report dated Jan. 2, 2020 from counterpart European Application No. 18165980.6, 2 pp.

Response to European Office Action dated Jan. 2, 2020, from European counterpart application No. 18165980.6, filed Jul. 13, 2020, 17 pp.

Response to European Search Report dated Aug. 9, 2018 from European counterpart application No. 18165980.6, filed Mar. 19, 2019, 17 pp.

* cited by examiner

HEARING ASSISTANCE DEVICE INCORPORATING A QUARTER WAVE STUB AS A SOLDERLESS ANTENNA CONNECTION

TECHNICAL FIELD

This application relates generally to hearing assistance devices, including hearing aids, personal amplification devices, and other hearables.

BACKGROUND

Hearing instruments can incorporate a radio and an antenna to wirelessly communicate with other devices. For example, a hearing instrument may receive audio from a transceiver which is connected to a television or a radio. This audio may be reproduced by the speaker of the hearing instrument, hereby allowing the wearer to hear the audio source without having to disturb others by turning up the volume on the audio source.

SUMMARY

According to some embodiments, a hearing assistance device for use by a wearer comprises an enclosure and a substrate comprising a circuit board disposed in the enclosure. An antenna is disposed within or on the enclosure. A feed arm arrangement is coupled to the circuit board. A section of the feed arm arrangement extends over the antenna and establishes a non-contacting electrical coupling with the antenna.

According to other embodiments, a hearing assistance device for use by a wearer comprises an enclosure comprising a first wall and an opposing second wall. A substrate comprising a circuit board is disposed in the enclosure. An antenna comprises a first side printed on the first wall of the enclosure and a second side printed on the second wall of the enclosure. A first feed arm and a second feed arm are respectively coupled to the circuit board. The first feed arm comprises a first section extending over and establishing a non-contacting electrical coupling with the first side of the antenna. The second feed arm comprises a second section extending over and establishing a non-contacting electrical coupling with the second side of the antenna.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1:
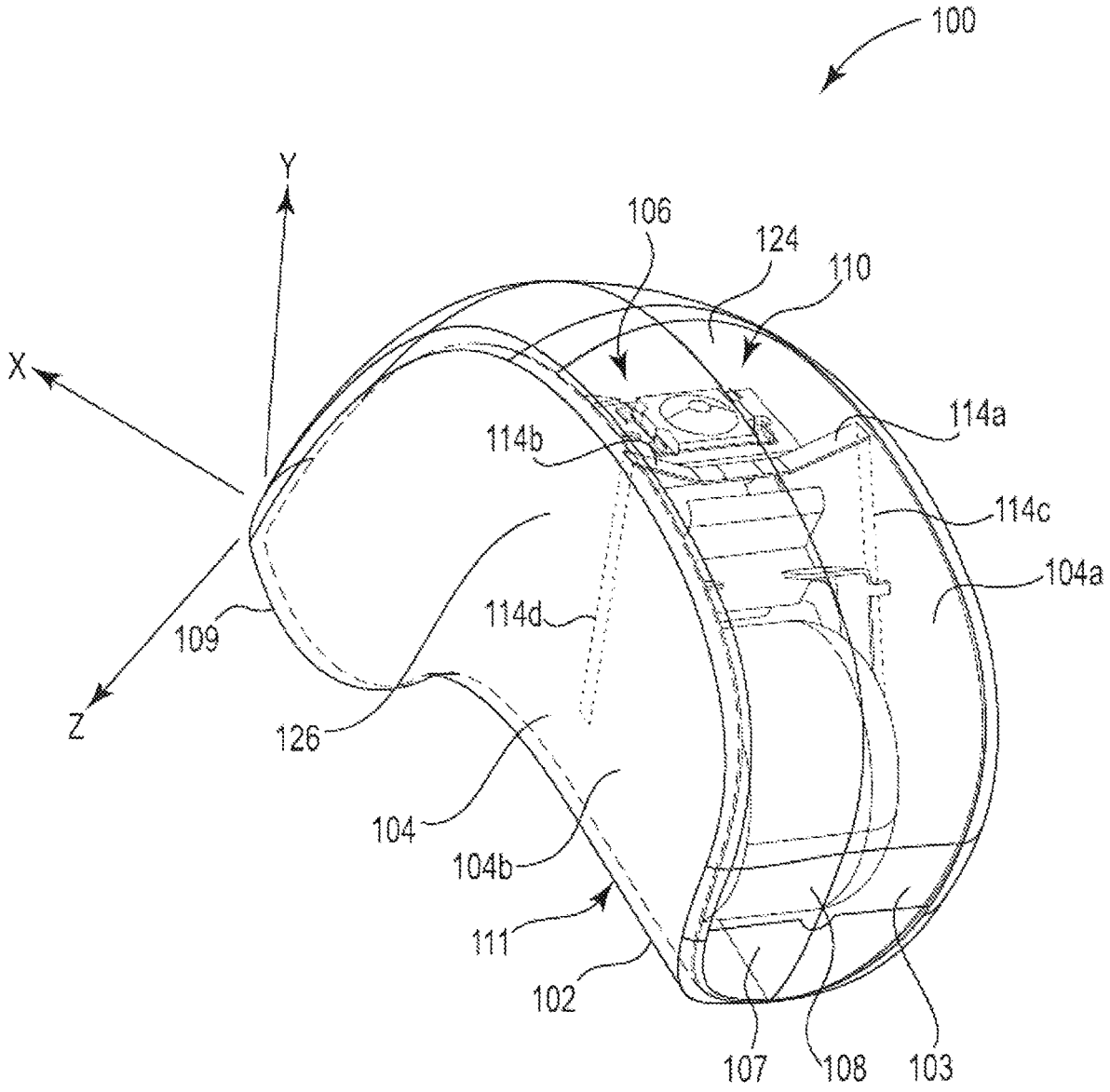
FIG. 1 illustrates a hearing assistance device incorporating an antenna and feed arm arrangement in accordance with various embodiments.

It is understood that the embodiments described herein may be used with any hearing assistance device without departing from the scope of this disclosure. The devices depicted in the figures are intended to demonstrate the subject matter, but not in a limited, exhaustive, or exclusive sense. It is also understood that the present subject matter can be used with a device designed for use in or on the right ear or the left ear or both ears of the wearer.

Embodiments of the disclosure are directed to a hearing assistance device which incorporates an antenna feed arm arrangement with a solderless connection between the antenna and a circuit board disposed within the hearing assistance device. The term solderless connection as used herein refers to a non-contacting electrical coupling. The term non-contacting electrical coupling refers to an electrical coupling between at least two elements that are not in direct physical contact with one another. Antenna feed arm arrangements that employ a solderless connection can be fabricated without using a conventional soldering process, which reduces cost and manufacturing complexity. Incorporating the antenna feed arm arrangement as an integral extension of the flexible circuit substrate of the hearing assistance device reduces costs and complexity associated with the fabrication and connection of physically separate antenna feed arms.

According to various embodiments, a hearing assistance device includes a feed arm arrangement coupled to a circuit board disposed within an enclosure (e.g., a shell) of the hearing assistance device. An antenna is disposed on or supported by the enclosure. In some embodiments, the antenna can be supported by a spine structure disposed in the enclosure. A section of the feed arm arrangement extends over the antenna and establishes a non-contacting electrical coupling with the antenna. For example, the feed arm may be integral to a polyimide circuit, such that the polyimide is in direct physical contact with the antenna but the electrically conductive feed arm is not in direct physical contact with the antenna.

The section of the feed arm arrangement that extends over the antenna preferably has an electrical length of approximately one-quarter of a wavelength of a signal transmitted or received by the antenna. In some embodiments, the section of the feed arm arrangement that extends over the antenna comprises a constant-width quarter wave stub. In other embodiments, the section of the feed arm arrangement that extends over the antenna comprises a radial stub. Other feed arm geometries are contemplated, such as a T geometry (e.g., see FIG. 5B).

Some embodiments of the disclosure are directed to a hearing assistance device which incorporates an antenna with solderless connections between multiple sides of the antenna and a circuit board disposed within the hearing assistance device. According to various embodiments, a hearing assistance device includes an enclosure comprising a first wall and an opposing second wall. An antenna comprises a first side and a second side. A feed arm arrangement comprises a first feed arm and a second feed arm. The first side of the antenna is supported by or positioned proximate the first wall of the enclosure, and the second side of the antenna is supported by or positioned proximate the second wall of the enclosure. The first feed arm comprises a first section extending over and establishing a non-contacting electrical coupling with the first side of the antenna. The second feed arm comprises a second section extending over and establishing a non-contacting electrical coupling with the second side of the antenna. Each of the first and second feed arm sections preferably has an electrical length of approximately one-quarter of a wavelength of a signal respectively transmitted or received by the antenna. The sections of the first and second feed arm arrangements that extend over the first and second sides of the antenna can comprise a constant-width quarter wave stub, a radial stub, or a stub having a different geometry (e.g., a T shape geometry).

Hearing assistance devices of the present disclosure can incorporate an antenna and feed arm arrangement coupled to a high-frequency radio, such as a 2.4 GHz radio or a radio of a different frequency. The antenna and feed arm arrangement can cooperate with a radio that conforms to an IEEE 802.11 (e.g., WiFi®) or Bluetooth® (e.g., BLE, Bluetooth® 4.2 or 5.0) specification, for example. It is understood that the antenna and feed arm arrangement may also be incorporated in hearing assistance devices that employ other radios, such as a 900 MHz radio. Hearing assistance devices that incorporate an antenna and feed arm arrangement of the present disclosure can be configured communicate and interact with a wireless assistive listening system. Wireless assistive listening systems are useful in a variety of situations and venues where listening by persons with impaired hearing have difficulty discerning sound (e.g., a person speaking or an audio broadcast or presentation). Wireless assistive listening systems can be useful at venues such as theaters, museums, convention centers, music halls, classrooms, restaurants, conference rooms, bank teller stations or drive-up windows, point-of-purchase locations, and other private and public meeting places. Hearing assistance devices that incorporate an antenna and feed arm arrangement of the present disclosure can be configured communicate and interact with a variety of other devices and systems, such as televisions, computers, tablets, laptops, and other devices.

The term hearing assistance devices refers to a wide variety of devices that can aid a person with impaired hearing. The term hearing assistance devices also refers to a wide variety of devices that can produce optimized or processed sound for persons with normal hearing. Hearing assistance devices of the present disclosure include hearables (e.g., wearable earphones, headphones, virtual reality headsets), hearing aids (e.g., hearing instruments), cochlear implants, and bone-conduction devices, for example. Hearing assistance devices can include a housing or enclosure within which various internal components are disposed. Typical internal components of a hearing assistance device can include a signal processor, memory, power management circuitry, one or more communication devices (e.g., a radio and a near-field magnetic induction device), one or more antennas, one or more microphones, and a receiver/speaker, for example. Hearing assistance devices can incorporate a communication device, such as a BLE transceiver, which can provide for enhanced connectivity with assistive listening systems. Hearing assistance devices include, but are not limited to, behind-the-ear (BTE), in-the-ear (ITE), in-the-canal (ITC), invisible-in-canal (IIC), receiver-in-canal (RIC), receiver-in-the-ear (RITE) and completely-in-the-canal (CIC) type hearing assistance devices. Hearing assistance devices can also be referred to as assistive listening devices in the context of assistive listening systems. Throughout this disclosure, reference is made to a "hearing assistance device," which is understood to refer to a single hearing assistance device or a pair of hearing assistance devices.

Figure 2:
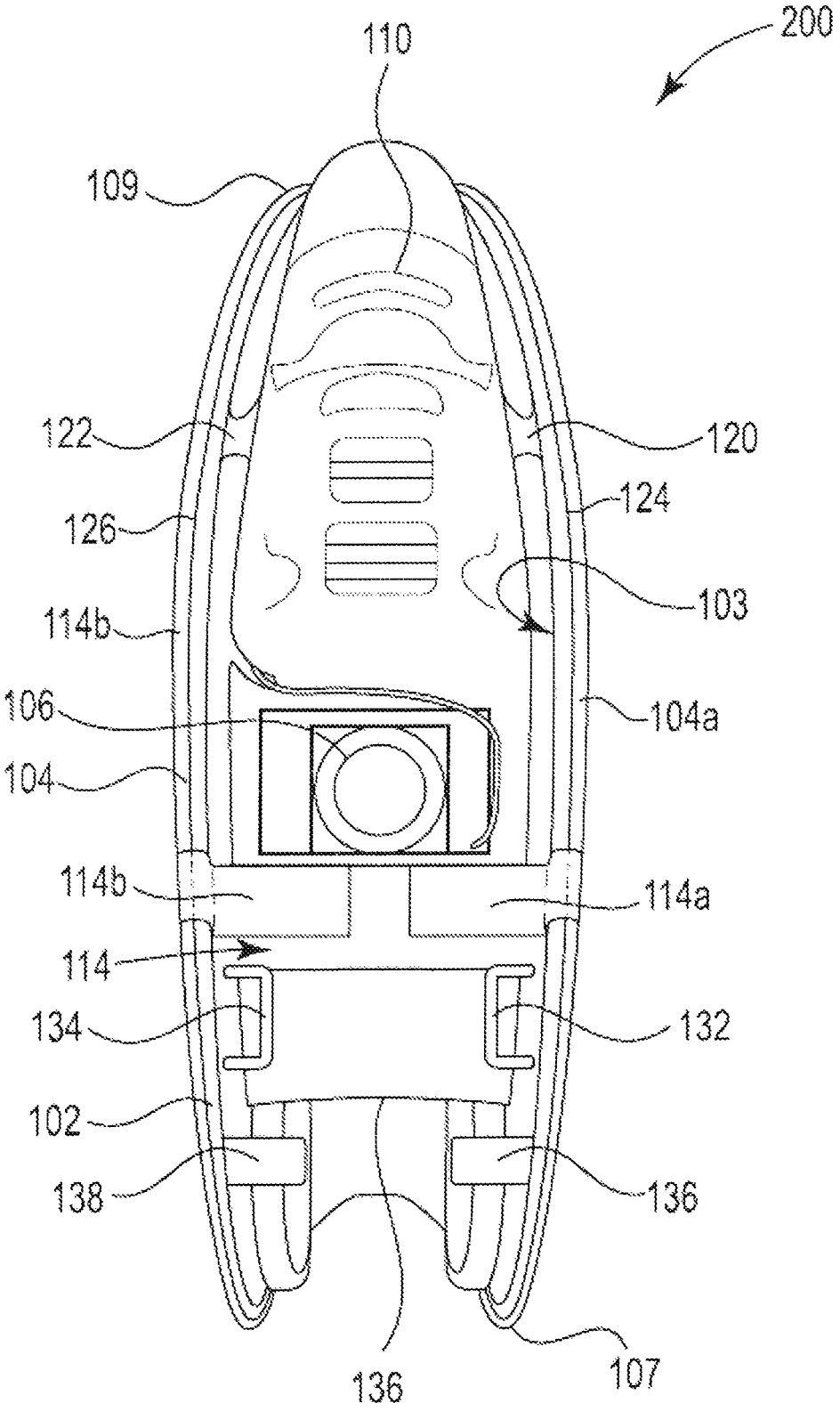
FIG. 2 illustrates an antenna and feed arm arrangement in accordance with other embodiments.

FIGS. 1 and 2 illustrate a hearing assistance device incorporating an antenna and feed arm arrangement in accordance with various embodiments. In the embodiment shown in FIGS. 1 and 2, the hearing assistance device 100 is of a behind-the-ear design. The hearing assistance device 100 includes an enclosure 102 having a first end 107 and an opposing second end 109. The enclosure 102 also includes a bottom 111, a removable top or cap (removed in FIGS. 1 and 2) opposing the bottom 111, and opposing sides 124 and 126, all of which extend between the first and second ends 107 and 109. In some embodiments, the enclosure 102 can have a tapered shape, such that the width of the enclosure 102 reduces along a longitudinal axis defined between the first and second ends 107 and 109. A battery 108 is shown positioned proximate the first end 107. The first end 107 can be hingedly connected to the enclosure 102 or otherwise configured to move between closed and open positions for installing and removing the battery 108.

A spine 110 (best seen in FIG. 2) extends longitudinally within the enclosure 102 between the battery 108 and the second end 109. The spine 110 is a structure inside the enclosure 102 that supports a flexible circuit substrate and electronics 106 of the hearing assistance device 100. The spine 110 includes supports or struts that are connected to interior surfaces 103 of the enclosure 102 and positionally fix the spine 110 within the enclosure 102. The spine 110 and/or the antenna 104 can include a number of struts that extend between the spine 110 and an interior surface 103 of the enclosure 102. In some embodiments, the antenna 104 can be positioned between the enclosure 102 and the spine 110, in which case the antenna 104 can include one or more apertures through which one or more struts (e.g., 120 and 122) can pass. Depending on the location of the struts, some of the struts (e.g., 120 and 122) pass through apertures of the antenna 104, while other struts (e.g., 132, 134, 136, 138) extend from an interior surface 103 of the enclosure 102 above the antenna 104 and terminate at mounting locations at the spine 110. Portions of the struts that pass through the antenna apertures can be electrically insulated from the folded antenna structure. It is noted that in some embodiments, an antenna can be printed on the spine 110, which would replace the antenna 104.

In the embodiment shown in FIG. 1, an antenna 104 of the hearing assistance device 100 is disposed in the interior of the enclosure 102. For example, the antenna 104 shown in FIG. 1 can be disposed on or situated proximate an interior surface 103 of the enclosure 102. In the embodiment shown in FIG. 2, the antenna 104 of the hearing assistance device 200 is disposed on the outside of the enclosure 102. In the embodiments shown in FIGS. 1 and 2, the antenna 104 has a shape that generally conforms to the shape of the enclosure walls. The antenna 104 shown in FIGS. 1 and 2 can be referred to as a shell antenna.

In some embodiments, the antenna 104 is a printed or patterned antenna. For example, the antenna 104 can be a laser direct structuring (LDS) structure. In other embodiments, the antenna 104 constitutes a metal plated structure. The antenna 104 can be plated inside and/or outside of the enclosure 102, essentially forming a solid metalized enclosure. In some embodiments, the antenna 104 can comprise a conductive layer on a flexible printed circuit board. For example, the antenna 104 can be formed as a polyimide flex circuit antenna. In other embodiments, the antenna 104 constitutes a stamped metal structure. The antenna 104 can incorporate a metal mesh or grid surrounded by solid metal. For example, a metal mesh or grid structure can be placed within an aperture of a metal frame that together define the antenna 104. Incorporating a metal mesh or grid pattern in the antenna structure can provide for a reduction in the area of the antenna 104.

If located within the enclosure 102, the antenna 104 can include apertures needed to accommodate elements of the hearing assistance device (e.g., struts, electrical/magnetic components). For example, the antenna 104 can be notched to mitigate interference with near-field coil antennas for other wireless communication systems of the hearing assistance device. The shape of the antenna's edge can be optimized to meet industrial design and wireless performance requirements.

A variety of antenna configurations are contemplated, including single-element and multiple-element antennas. For example, a single-element antenna 104 can define a continuous unitary structure. A single-element antenna 104 can be implemented as a shell antenna, a monopole antenna, or a PIFA (planar inverted-F antenna), for example. A multiple-element antenna 104 can be a discontinuous structure comprising a multiplicity of connected antenna elements. A multiple-element antenna 104 can be implemented as a dipole antenna or a bowtie antenna, for example.

The embodiments shown in FIGS. 1 and 2 include a single-element antenna 104 comprising a first side 104*a* disposed on or proximate the first wall 124 of the enclosure 102. The antenna 104 comprises a second side 104*b* disposed on or proximate the second wall 126 of the enclosure 102. In FIG. 1, the first and second sides 104*a* and 104*b* of the antenna 104 are disposed on or proximate the interior surface 103 of the first and second walls 124 and 126 of the enclosure 102, respectively. In FIG. 2, the first and second sides 104*a* and 104*b* of the antenna 104 are disposed on the exterior surface of the first and second walls 124 and 126 of the enclosure 102, respectively. The antenna 104 covers an appreciable portion of the wall surfaces of the enclosure 102. More particularly, the first side 104*a* of the antenna 104 covers an appreciable portion (e.g., >50%) of the first wall 124 of the enclosure 102. The second side 104*b* of the antenna 104 covers an appreciable portion (e.g., >50%) of the second wall 126 of the enclosure 102. For example, the first and second sides 104*a* and 104*b* of the antenna 104 can cover at least 60%, 70%, 80% or 90% of the first and second walls 124 and 126 of the enclosure 102.

A feed arm arrangement 114 is provided to electrically couple the antenna 104 to a radio of the electronics 106. As is shown in FIG. 1 and other figures, the feed arm arrangement 114 is electrically coupled to a circuit board within the enclosure 102 that supports the electronics 106. The feed arm arrangement 114 is configured to include a section that extends over the antenna 104 and establishes a non-contacting (e.g., solderless) electrical coupling with the antenna 104.

In the embodiment shown in FIGS. 1 and 2, the feed arm arrangement 114 includes a first feed arm 114*a* and a second feed arm 114*b*. The first feed arm 114*a* is configured to establish non-contacting electrical coupling with the first side 104*a* of the antenna 104. The second feed arm 114*b* is configured to establish non-contacting electrical coupling with the second side 104*b* of the antenna 104. The first feed arm 114*a* includes a section 114*c* that extends over the first side 104*a* of the antenna 104. The second feed arm 114*b* includes a section 114*d* that extends over the second side 104*b* of the antenna 104. The sections 114*c* and 114*d* of the feed arm arrangement 114 extending over the first and second sides 104*a* and 104*b* of the antenna 104 preferably have an electrical length of approximately one-quarter of a wavelength of a signal transmitted or received by the antenna 104. The location of the feed arm arrangement 114 can be selected to optimize the input impedance, effective length, radiation efficiency, and other characteristics of the antenna 104.

Figure 3:
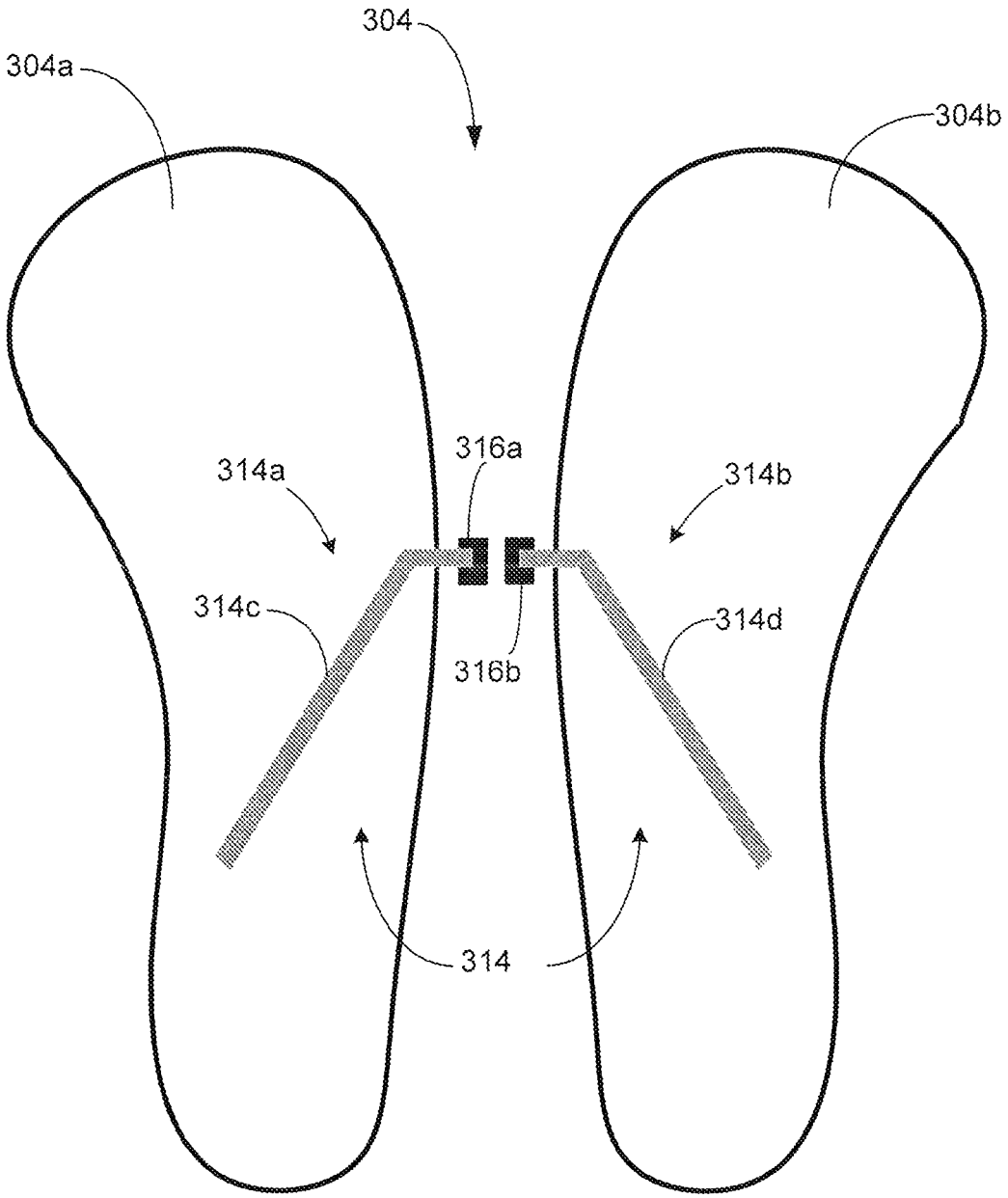
FIG. 3 illustrates an antenna and feed arm arrangement in accordance with further embodiments.

The embodiment shown in FIG. 3 is directed to a dual-element antenna 304 comprising a first element 304*a* and a second element 304*b*. The antenna 304 shown in FIG. 3 can be referred to as a bowtie antenna. The first element 304*a* can be disposed on or proximate a first enclosure wall of a hearing assistance device. The second element 304*b* can be disposed on or proximate a second enclosure wall of the hearing assistance device. In some embodiments, the antenna 304 can be situated within the enclosure of the hearing assistance device (e.g., on or proximate the enclosure walls or supported by or printed on the spine of the enclosure). In other embodiments, the antenna 304 can be situated (e.g., affixed or printed) on the exterior surface of the enclosure.

A feed arm arrangement 314 is provided to electrically couple the antenna 304 to a radio of the electronics housed in the enclosure of the hearing assistance device. The feed arm arrangement 314 is electrically coupled to a circuit board within the enclosure via electrical contacts 316*a* and 316*b*. The feed arm arrangement 314 is configured to include sections 314*c* and 314*d* that extend over the antenna elements 304*a* and 304*b* and establish a non-contacting (e.g., solderless) electrical coupling with the antenna elements 304*a* and 304*b*.

In the embodiment shown in FIG. 3, the feed arm arrangement 314 includes a first feed arm 314*a* and a second feed arm 314*b*. The first feed arm 314*a* is configured to establish non-contacting electrical coupling with the first element 304*a* of the antenna 304. The second feed arm 314*b* is configured to establish non-contacting electrical coupling with the second element 304*b* of the antenna 304. The first feed arm 314*a* includes a section 314*c* that extends over the first element 304*a* of the antenna 104. The second feed arm 314*b* includes a section 314*d* that extends over the second element 304*b* of the antenna 304. The sections 314*c* and 314*d* of the feed arm arrangement 314 extending over the first and second elements 304*a* and 304*b* of the antenna 304 (relative to the periphery of the first and second elements 304*a* and 304*b*) preferably have an electrical length of approximately one-quarter of a wavelength of a signal transmitted or received by the antenna 304. The location of the feed arm arrangement 314 can be selected to optimize the input impedance, effective length, radiation efficiency, and other characteristics of the antenna 304.

Figure 4:
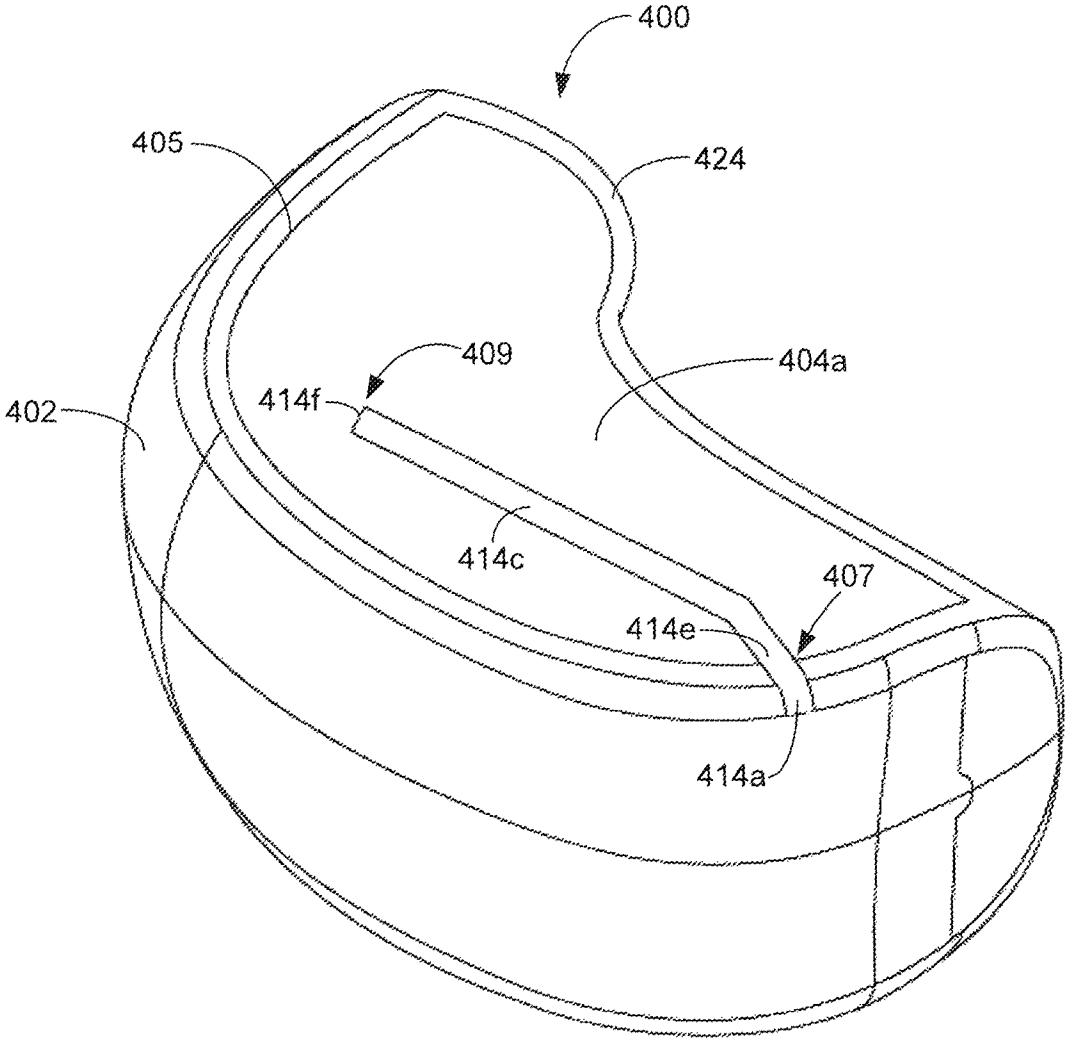
FIG. 4 is an illustration of a hearing assistance device which incorporates an antenna and feed arm arrangement in accordance with various embodiments.

FIG. 4 is an illustration of a hearing assistance device 400 incorporating an antenna and feed arm arrangement in accordance with various embodiments. FIG. 4 shows details of one side 424 of an enclosure 402 which includes a first side 404*a* of the antenna. The first side 404*a* of the antenna can be printed, patterned, plated or affixed on the outside surface of the enclosure 402 (e.g., via LDS). A feed arm arrangement 414*a* is shown exiting the interior of the enclosure 402 and extending over the first side 404*a* of the antenna. In an alternative embodiment, the first side 404*a* of the antenna covers the inside surface of the enclosure 402 and the feed arm arrangement 414*a* is also positioned proximate the inside surface of the enclosure 402 (see e.g., FIG. 1). It is understood that the opposing side (not shown) of the enclosure 402 includes a second side of the antenna and a second feed arm arrangement.

The first side 404*a* of the antenna has a perimeter 405. A section 414*c* of the feed arm arrangement 414*a* extends over the first antenna side 404*a* and defines a transmission line in the form of a constant-width quarter wave stub. The transmission line 414*c* is configured to establish non-contacting electrical coupling with the first antenna side 404*a*. The transmission line 414*c* includes a first location 414*e* which is in alignment with the perimeter 405 of the first antenna side 404*a* at a position 407, and a second location 414*f* which is situated within the first antenna side 404*a* at a position 409. The transmission line 414*c* has an electrical length of approximately one-quarter of a wavelength of a signal transmitted or received by the antenna (or shorter depending on dielectric loading). The transmission line 414*c* is configured to transform an open circuit at the second location 414*f* to a short circuit at the first location 414*e*.

Figure 5A:
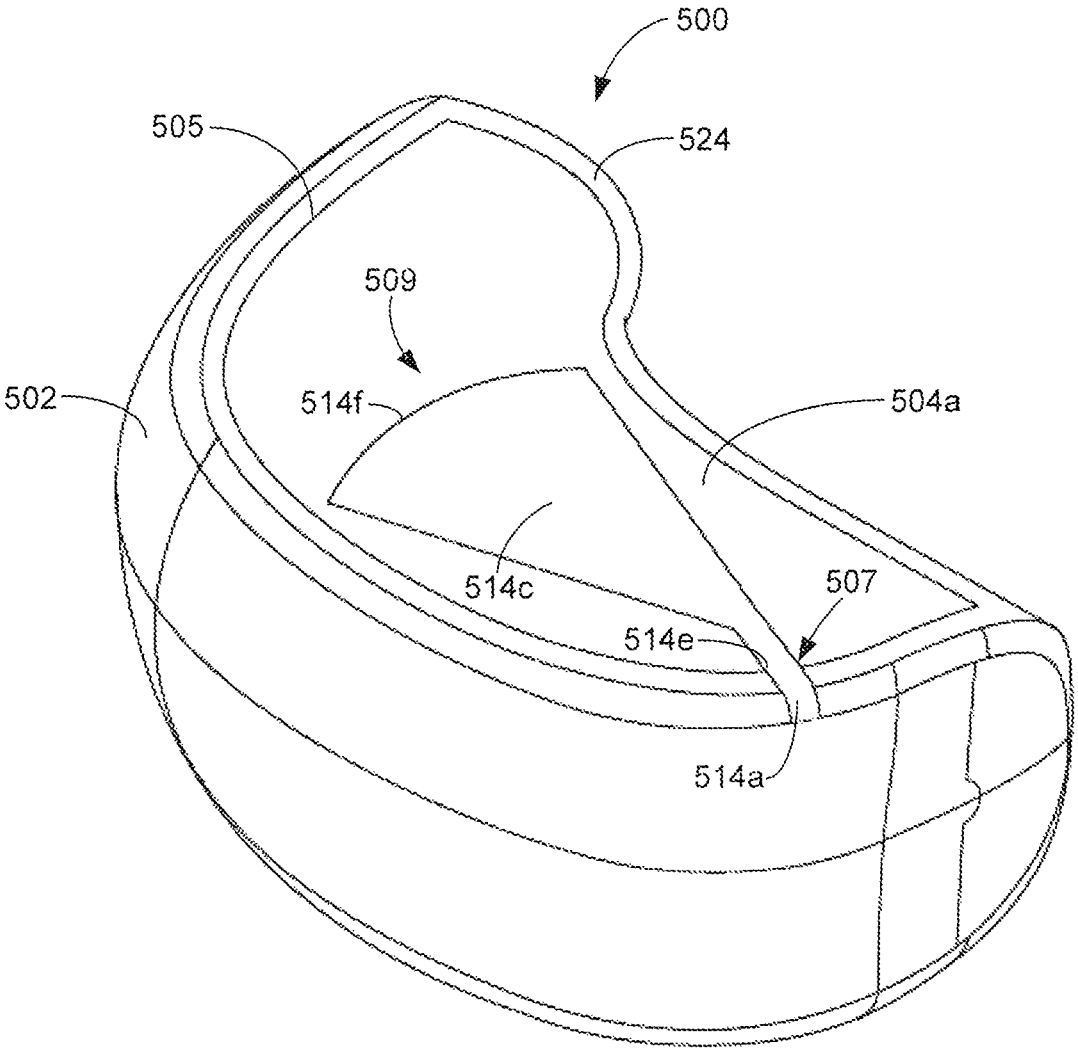
FIG. 5A is an illustration of a hearing assistance device which incorporates an antenna and feed arm arrangement in accordance with other embodiments.

FIG. 5A is an illustration of a hearing assistance device 500 incorporating an antenna and feed arm arrangement in accordance with various embodiments. FIG. 5A shows details of one side 524 of an enclosure 502 which includes a first side 504*a* of the antenna, which can be printed, patterned, plated or affixed on the outside surface of the enclosure 502. A feed arm arrangement 514*a* is shown exiting the interior of the enclosure 502 and extending over the first side 504*a* of the antenna. In an alternative embodiment, the first antenna side 504*a* covers the inside surface of the enclosure 502 and the feed arm arrangement 514*a* is also positioned proximate the inside surface of the enclosure 502 (see e.g., FIG. 1). It is understood that the opposing side (not shown) of the enclosure 502 includes a second side of the antenna and a second feed arm arrangement.

The first side 504*a* of the antenna has a perimeter 505. A section 514*c* of the feed arm arrangement 514*a* extends over the first antenna side 504*a* and defines a transmission line in the form of a radial stub. The transmission line 514*c* is configured to establish non-contacting electrical coupling with the first antenna side 504*a*. The transmission line 514*c* includes a first location 514*e* which is in alignment with the perimeter 505 of the first antenna side 504*a* at a position 507, and a second location 514*f* which is situated within the first antenna side 504*a* at a position 509. The transmission line 514*c* can have an electrical length of approximately one-quarter of a wavelength of a signal transmitted or received by the antenna (or less due to dielectric loading). The transmission line 514*c* is configured to transform an open circuit at the second location 514*f* to a short circuit at the first location 514*e*.

Figure 5B:
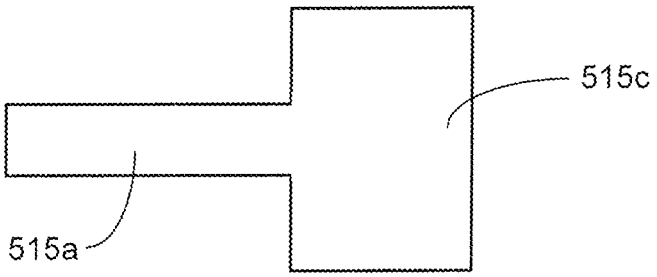
FIG. 5B is an illustration of a feed arm stub arrangement in accordance with some embodiments.

In other embodiments, stub arrangements having different geometries can be used, such as the stub arrangement illustrated in FIG. 5B. The stub arrangement shown in FIG. 5B can be termed a T-shaped stub arrangement comprising a rectangular feed arm arrangement 515*a* and a rectangular or square transmission line 515*c*.

In the embodiments illustrated in FIGS. 4 and 5A, the coupling feed arm sections 414*c* and 514*c* effectively make a solderless connection to the first antenna sides 404*a* and 504*a*. Dielectric loading can be employed to reduce the size of the coupling feed arm sections 414*c* and 514*c*. In general, the feed arm section 514*c* configured as a radial stub (FIG. 5A) provides a broader bandwidth and improved performance over the feed arm section 414*c* configured as a constant-width quarter wave stub (FIG. 4). The radial stub 514*c* can be used to compensate for manufacturing variation and can aid in the design process.

The transformation of the transmission line 414*c*/514*c* from an open circuit over the first antenna sides 404*a*/504*a* to a short circuit at the input (perimeter 405/505) of the first antenna sides 404*a*/504*a* provides for a low RF loss feed arm/antenna interconnect. Moreover, this low RF loss feed arm/antenna interconnect eliminates the need for a solder connection between the feed arm 414*a*/514*a* and the first antenna sides 404*a*/504*a*.

Figure 6:
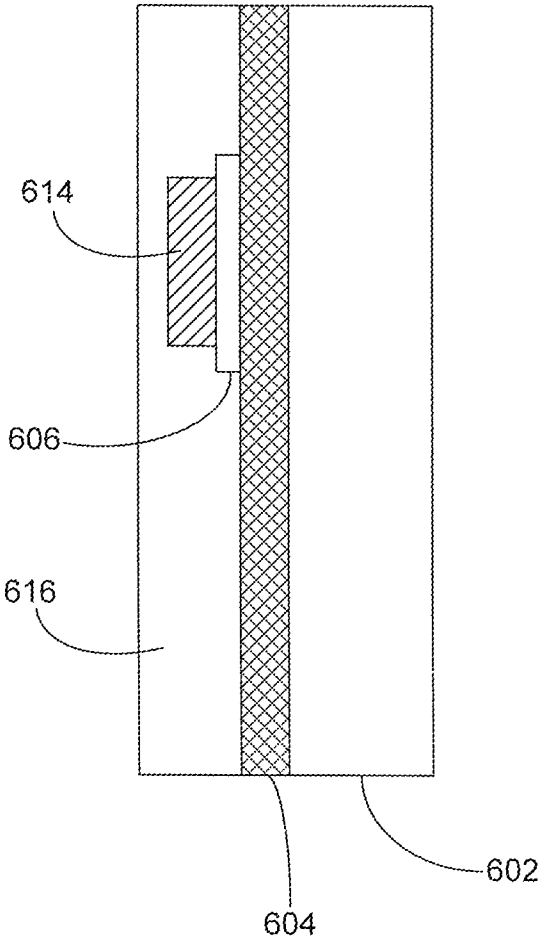
FIG. 6 is a cross-sectional view of a portion of a hearing assistance device incorporating an antenna and feed arm arrangement in accordance with various embodiments.

FIG. 6 is a cross-sectional view of a portion of a hearing assistance device incorporating an antenna and feed arm arrangement in accordance with various embodiments. FIG. 6 shows a portion of an enclosure 602 of the hearing assistance device to which an antenna 604 is affixed. The antenna 604 can be printed, patterned, plated or otherwise formed on the enclosure 602 (e.g., via LDS). The antenna 604 can be a single-element or multiple-element antenna. The enclosure 602 can be formed from a polymeric material, such as a polyamide (e.g., nylon), polycarbonate or fluoropolymer (e.g., PTFE) material. Suitable examples of materials for the enclosure 602 include Ultramid® (polyamides and copolyamides), Grilamid TR® (semi-crystalline polyamide and an amorphous thermoplastic), and Xantar® (polycarbonate thermoplastic resin). The antenna 604 can be formed from a metal or alloy, such as copper, silver, gold or alloys thereof. An insulator 606, such as a dielectric, is situated between the antenna 604 and a transmission line 614 configured as a quarter wave stub (e.g., constant-width or radial). The transmission line 614 can be formed from a metal or alloy, such as copper, silver, gold or alloys thereof. The insulator 606 can be formed from various materials, such as polyimide, polyester, polyetherimide, polytetrafluoroethylene (PTFE), silicone or glass-based dielectric, for example.

A protective layer 616 can cover the exposed portion of the antenna 604 and the transmission line 614. The protective layer 616 can be formed using a material listed above for the insulator 606 or other material. In some embodiments, the protective layer 616 comprises polyimide or other polymer which encases the antenna 604, as in the case of a flex circuit antenna.

The dielectric constant of the insulator 606 can be selected to change the physical length of the transmission line 614 (e.g., quarter-wavelength stub or radial stub). The thickness of the dielectric can be selected to control the characteristic impedance of the transmission line 614, allowing the width of the transmission line 614 to be changed.

Combined, this allows the transmission line 614 to be designed to fit the mechanical dimensions of the enclosure 602 of the hearing assistance device.

In some embodiments, the antenna 604, insulator 606, transmission line 614, and protective layer 616 are formed on the inside surface of the enclosure 602. In other embodiments, the antenna 604, insulator 606, transmission line 614, and protective layer 616 are formed on the outside surface of the enclosure 602.

According to other embodiments, an antenna of the hearing assistance device can be printed on the spine disposed in the enclosure of the hearing assistance device. For example, and with reference to FIG. 6, the component 602 can represent the spine of the enclosure. The antenna 604 can be printed on the spline 602. The insulator 606 can be situated between the antenna 604 and a transmission line 614 configured as a quarter wave stub (e.g., constant-width or radial).

Figure 7:
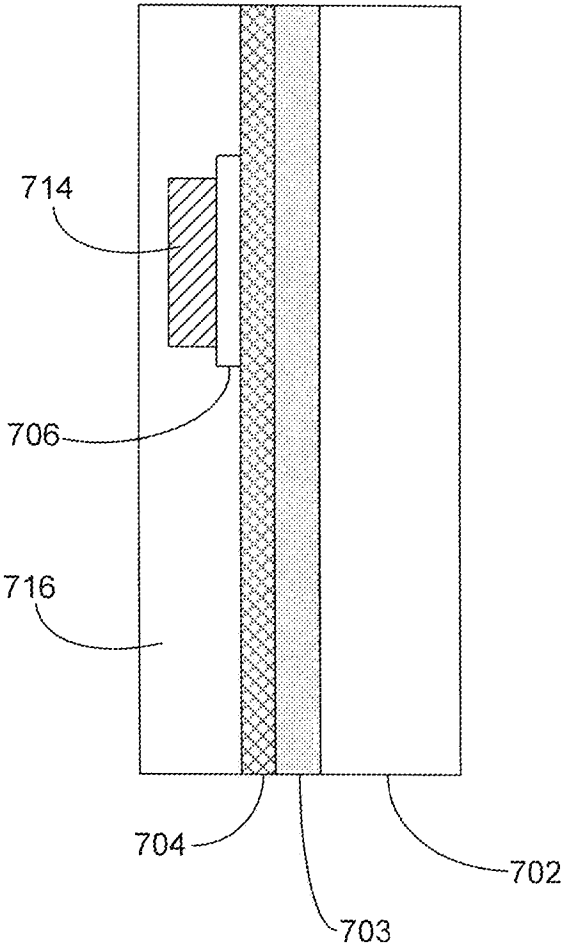
FIG. 7 is a cross-sectional view of a portion of a hearing assistance device incorporating an antenna and feed arm arrangement in accordance with other embodiments.

FIG. 7 is a cross-sectional view of a portion of a hearing assistance device incorporating an antenna and feed arm arrangement in accordance with various embodiments. FIG. 7 shows a portion of an enclosure 702 of the hearing assistance device to which an antenna 704 is affixed via an adhesive 703. The antenna 704 can be discrete antenna, such as a stamped antenna or an antenna having a metal mesh or grid structure surrounded by a metal frame. The antenna 704 can be a single-element or multiple-element antenna. The adhesive 703 can be a pressure sensitive adhesive or a structural adhesive (e.g., two part epoxy). An insulator 706, such as a dielectric, is situated between the antenna 704 and a transmission line 714 configured as a quarter wave stub (constant-width or radial). As was discussed previously, the dielectric constant of the insulator 706 can be selected to change the physical length of the transmission line 714 (e.g., quarter-wavelength stub or radial stub). The thickness of the dielectric can be selected to control the characteristic impedance of the transmission line 714, allowing the width of the transmission line 714 to be changed. Combined, this allows the transmission line 714 to be designed to fit the mechanical dimensions of the enclosure 702 of the hearing assistance device.

A protective layer 716 can cover the exposed portion of the antenna 704 and the transmission line 714. The enclosure 702, antenna 704, insulator 706, transmission line 714, and protective layer 716 can be formed using the materials listed above for the embodiment shown in FIG. 6. In some embodiments, the protective layer 716 comprises polyimide or other polymer which encases the antenna 704, as in the case of a flex circuit antenna.

In some embodiments, the adhesive 703, antenna 704, insulator 706, transmission line 714, and protective layer 716 are formed on the inside surface of the enclosure 702. In other embodiments, the adhesive 703, antenna 704, insulator 706, transmission line 714, and protective layer 716 are formed on the outside surface of the enclosure 702.

Figure 8:
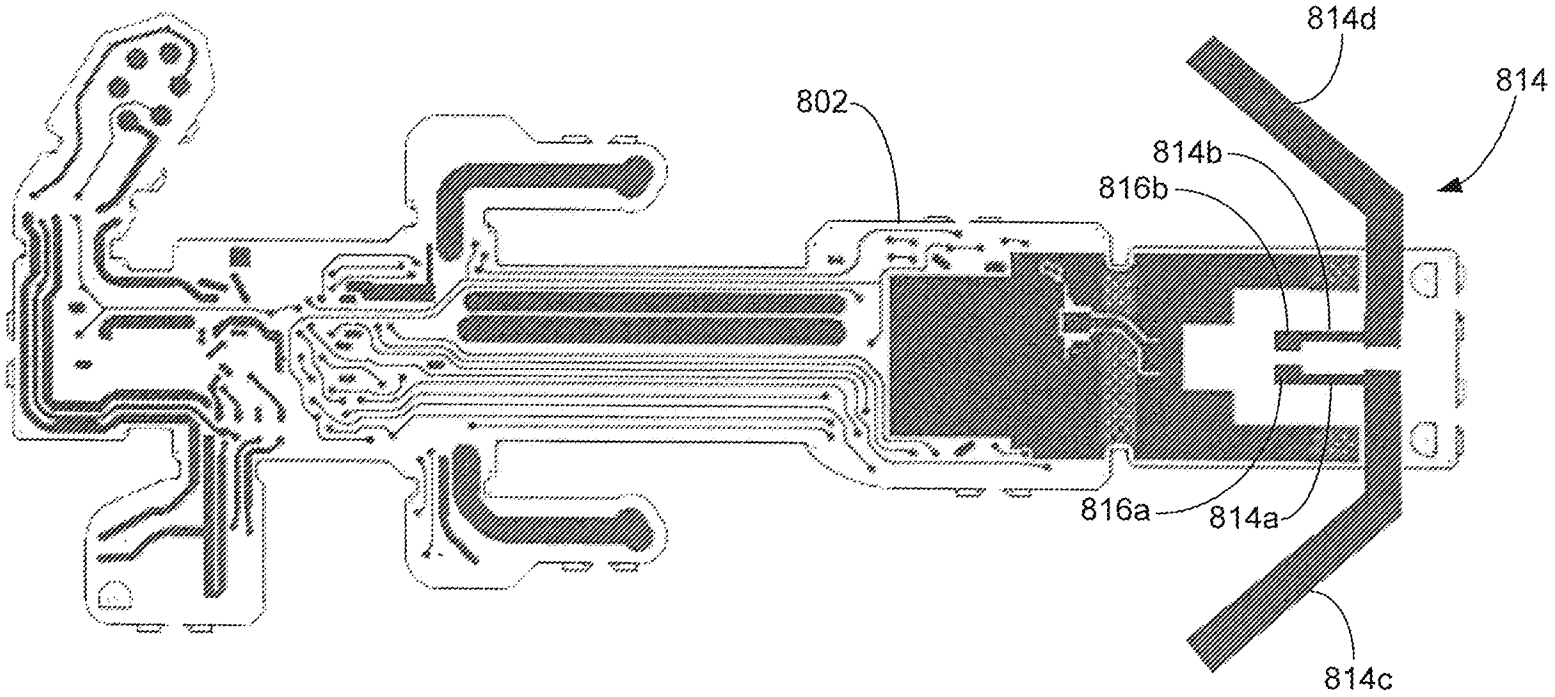
FIG. 8 shows a representative flexible circuit substrate which incorporates an integral feed arm arrangement for establishing non-contacting electrical coupling with an antenna of a hearing assistance device in accordance with various embodiments.

FIG. 8 shows a representative flexible circuit substrate 802 which incorporates an integral feed arm arrangement 814 for establishing non-contacting electrical coupling with an antenna of a hearing assistance device in accordance with various embodiments. The flexible circuit substrate 802 is disposed within the enclosure of the hearing assistance device and is supported by the spine (see, e.g., FIGS. 1 and 2). The electronics and battery of the hearing assistance device are mounted or connected to the flexible circuit substrate 802.

The flexible circuit substrate 802 includes a feed arm arrangement 814 comprising a first feed arm 814*a* and a second feed arm 814*b*. The first feed arm 814*a* includes an integral first section 814*c*, and the second feed arm 814*b* includes an integral second section 814*d*. The first and second sections 814*c* and 814*d* are continuous extensions of the flexible circuit substrate 802. The first feed arm 814*a* also includes a first contact 816*a* and the second feed arm 814*b* includes a second contact 816*b*. The first and second contacts 816*a* and 816*b* are configured to electrically connect with a radio of the electronics of the flexible circuit substrate 802. The first feed arm 814*a* is preferably a continuous physical structure (e.g., no solder connections) between the first contact 816*a* and the terminal end of the first section 814*c*. The second feed arm 814*b* is preferably a continuous physical structure (e.g., no solder connections) between the second contact 816*b* and the terminal end of the second section 814*c*.

The first and second sections 814*c* and 814*d* of the first and second feed arms 814*a* and 814*b* are configured to establish a non-contacting electrical coupling with respective first and second sides of an antenna of the hearing assistance device. In the embodiment shown in FIG. 8, the first and second sections 814*c* and 814*d* are configured as constant-width quarter wave stubs. As discussed previously, the first and second sections 814*c* and 814*d* have an electrical length of approximately one-quarter of a wavelength of a signal respectively transmitted or received by the antenna of the hearing assistance device.

Figure 9:
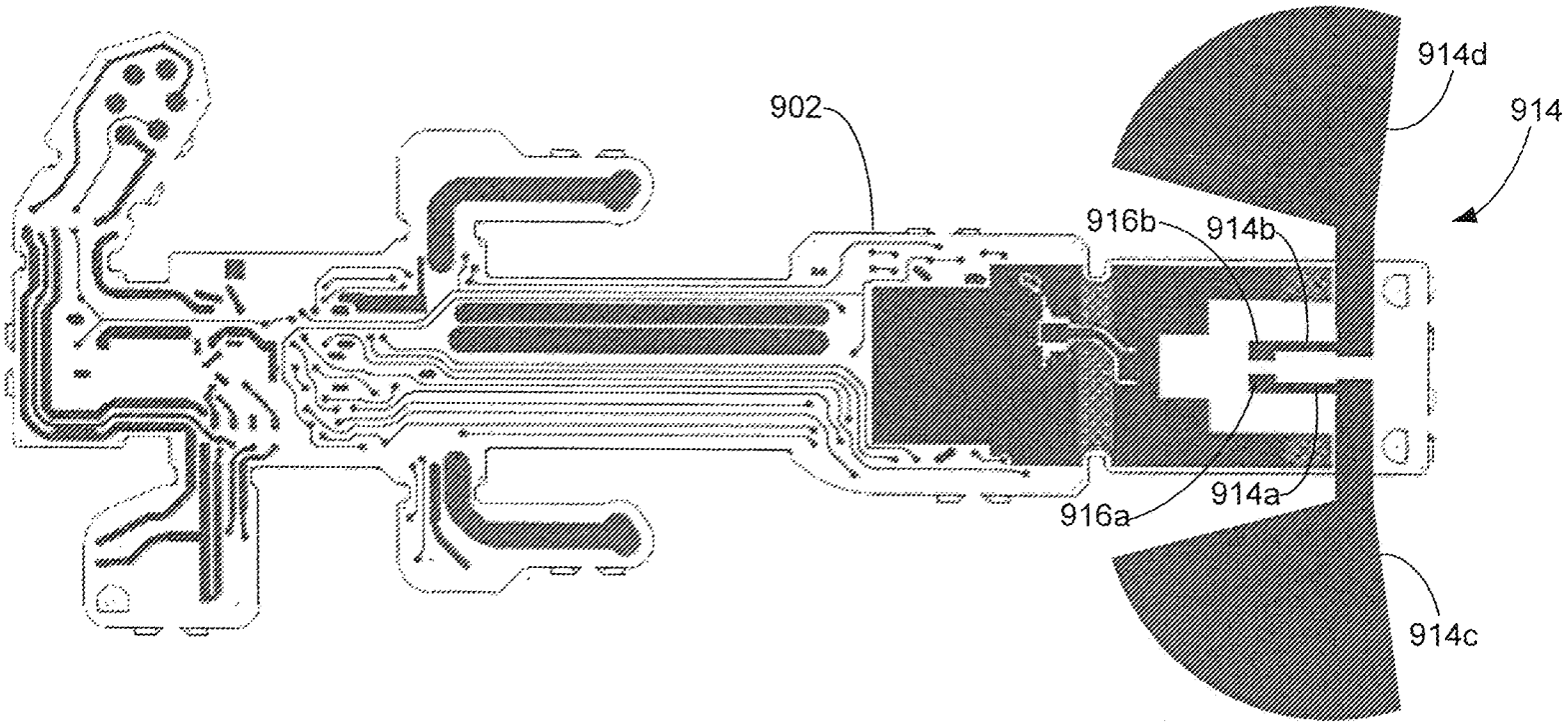
FIG. 9 shows a representative flexible circuit substrate which incorporates an integral feed arm arrangement for establishing non-contacting electrical coupling with an antenna of a hearing assistance device in accordance with other embodiments.

FIG. 9 shows a representative flexible circuit substrate 902 which incorporates an integral feed arm arrangement 914 for establishing non-contacting electrical coupling with an antenna of a hearing assistance device in accordance with various embodiments. The flexible circuit substrate 902 is disposed within the enclosure of the hearing assistance device and is supported by the spine. The electronics and battery of the hearing assistance device are mounted or connected to the flexible circuit substrate 902.

The flexible circuit substrate 902 includes a feed arm arrangement 914 comprising a first feed arm 914*a* and a second feed arm 914*b*. The first feed arm 914*a* includes an integral first section 914*c*, and the second feed arm 914*b* includes an integral second section 914*d*. The first and second sections 914*c* and 914*d* are continuous extensions of the flexible circuit substrate 902. The first feed arm 914*a* also includes a first contact 916*a* and the second feed arm 914*b* includes a second contact 916*b*. The first and second contacts 916*a* and 916*b* are configured to electrically connect with a radio of the electronics of the flexible circuit substrate 902. The first feed arm 914*a* is preferably a continuous physical structure (e.g., no solder connections) between the first contact 916*a* and the terminal end of the first section 914*c*. The second feed arm 914*b* is preferably a continuous physical structure (e.g., no solder connections) between the second contact 916*b* and the terminal end of the second section 914*c*.

The first and second sections 914*c* and 914*d* of the first and second feed arms 914*a* and 914*b* are configured to establish a non-contacting electrical coupling with respective first and second sides of an antenna of the hearing assistance device. In the embodiment shown in FIG. 9, the first and second sections 914*c* and 914*d* are configured as radial stubs. The first and second sections 914*c* and 914*d* can have an electrical length of approximately one-quarter of a wavelength of a signal respectively transmitted or received by the antenna of the hearing assistance device.

This document discloses numerous embodiments, including but not limited to the following:

Item 1 is a hearing assistance device for use by a wearer, comprising:

an enclosure;

a substrate comprising a circuit board disposed in the enclosure;

an antenna disposed within or on the enclosure; and a feed arm arrangement coupled to the circuit board, a section of the feed arm arrangement extending over the antenna and establishing a non-contacting electrical coupling with the antenna.

Item 2 is a hearing assistance device of claim 1, wherein the section of the feed arm arrangement extending over the antenna has an electrical length of approximately one-quarter of a wavelength of a signal transmitted or received by the antenna.

Item 3 is a hearing assistance device of claim 1, wherein the section of the feed arm arrangement comprises a radial stub.

Item 4 is a hearing assistance device of claim 1, wherein:

the antenna comprises an antenna element having a perimeter;

the section of the feed arm arrangement extending over the antenna defines a transmission line comprising a first location and a second location;

the first location of the transmission line is in alignment with the perimeter; and the second location of the transmission line is situated within the antenna element.

Item 5 is a hearing assistance device of claim 4, wherein the transmission line is configured to transform an open circuit at the second location to a short circuit at the first location.

Item 6 is a hearing assistance device of claim 1, wherein:

the enclosure comprises a first wall and an opposing second wall;

the antenna comprises a first side and a second side;

the feed arm arrangement comprises a first feed arm and a second feed arm;

the first side of the antenna is supported by or positioned proximate the first wall of the enclosure;

the second side of the antenna is supported by or positioned proximate the second wall of the enclosure;

the first feed arm comprises a first section extending over and establishing a non-contacting electrical coupling with the first side of the antenna; and the second feed arm comprises a second section extending over and establishing a non-contacting electrical coupling with the second side of the antenna.

Item 7 is a hearing assistance device of claim 6, wherein each of the first and second feed arm sections has an electrical length of approximately one-quarter of a wavelength of a signal respectively transmitted or received by the antenna.

Item 8 is a hearing assistance device of claim 1, wherein the antenna defines a Laser Direct Structuring (LDS) structure disposed on the enclosure.

Item 9 is a hearing assistance device of claim 1, wherein:

the enclosure comprises a first wall and an opposing second wall;

the antenna comprises a first side and a second side;

the first side of the antenna defines a printed structure disposed on the first wall of the enclosure; and the second side of the antenna defines a printed structure disposed on the second wall of the enclosure.

Item 10 is a hearing assistance device of claim 1, wherein the antenna comprises a stamped metal antenna or a flex circuit antenna.

Item 11 is a hearing assistance device of claim 1, wherein:

a spine is disposed in the enclosure; and the antenna is printed on or supported by the spine.

Item 12 is a hearing assistance device of claim 1, further comprising an insulator material disposed between the feed arm section and the antenna.

Item 13 is a hearing assistance device of claim 1, wherein the feed arm arrangement defines a continuous section of the circuit board.

Item 14 is a hearing assistance device of claim 1, wherein the non-contacting electrical coupling is a solderless coupling.

Item 15 is a hearing assistance device for use by a wearer, comprising:

an enclosure comprising a first wall and an opposing second wall;

a substrate comprising a circuit board disposed in the enclosure;

an antenna comprising a first side printed on the first wall of the enclosure and a second side printed on the second wall of the enclosure;

a first feed arm and a second feed arm respectively coupled to the circuit board;

the first feed arm comprising a first section extending over and establishing a non-contacting electrical coupling with the first side of the antenna; and the second feed arm comprising a second section extending over and establishing a non-contacting electrical coupling with the second side of the antenna.

Item 16 is a hearing assistance device of claim 15, wherein the antenna comprises a stamped metal antenna, a flex circuit antenna or a printed antenna.

Item 17 is a hearing assistance device of claim 15, wherein the first and second sides of the antenna define a Laser Direct Structuring (LDS) structure.

Item 18 is a hearing assistance device of claim 15, wherein each of the first and second feed arm sections has an electrical length of approximately one-quarter of a wavelength of a signal respectively transmitted or received by the antenna.

Item 19 is a hearing assistance device of claim 15, wherein each of the first and second feed arm sections comprises a radial stub.

Item 20 is a hearing assistance device of claim 15, further comprising an insulator material disposed between the first feed arm section and the first side of the antenna, and between the second feed arm section and the second side of the antenna.

Item 21 is a hearing assistance device of claim 15, wherein the first and second feed arms define continuous sections of the circuit board.

Item 22 is a hearing assistance device of claim 15, wherein the non-contacting electrical couplings are solderless couplings.

Although the subject matter has been described in language specific to structural features and/or methodological acts, it is to be understood that the subject matter defined in the appended claims is not necessarily limited to the specific features or acts described above. Rather, the specific features and acts described above are disclosed as representative forms of implementing the claims.

What is claimed is:

1. A hearing assistance device for use by a wearer, comprising:

an enclosure that comprises a first wall and an opposing second wall;

a flexible substrate comprising a circuit board disposed in the enclosure, wherein the circuit board supports electronics of the hearing assistance device;

an antenna disposed within or on the enclosure, wherein:

the antenna comprises a first antenna element and a second antenna element, wherein the first antenna element is not physically connected to the second antenna element, the first antenna element of the antenna is supported by or positioned proximate the first wall of the enclosure, and the second antenna element of the antenna is supported by or positioned proximate the second wall of the enclosure; and a feed arm arrangement coupled to and defining a continuous section of the circuit board, the feed arm arrangement comprising a first feed arm and a second feed arm, wherein:

the first feed arm comprises a first section that defines a first transmission line that extends over and establishes a first non-contacting electrical transmission line coupling with the first antenna element, the first section of the first feed arm has an electrical length of approximately one-quarter of a wavelength of a signal transmitted or received by the antenna, and the first section of the first feed arm extending over the first antenna element transforms the first transmission line from an open circuit over the first antenna element to a short circuit at an input of the first antenna element, the second feed arm comprises a second section that defines a second transmission line that extends over and establishes a second non-contacting electrical transmission line coupling with the second antenna element, and the second section of the second feed arm has an electrical length of approximately one-quarter of the wavelength of the signal transmitted or received by the antenna, and the second section of the second feed arm extending over the second antenna element transforms the second transmission line from an open circuit over the second antenna element to a short circuit at an input of the second antenna element.

2. The hearing assistance device of claim 1, wherein:

the first transmission line comprises a first radial stub, and the second transmission line comprises a second radial stub.

3. The hearing assistance device of claim 1, wherein:

the first antenna element has a perimeter;

the first transmission line comprises a first location and a second location;

the first location of the first transmission line is in alignment with the perimeter; and the second location of the first transmission line is situated within the first antenna element.

4. The hearing assistance device of claim 1, wherein the antenna defines a Laser Direct Structuring (LDS) structure disposed on the enclosure.

5. The hearing assistance device of claim 1, wherein:

the first antenna element defines a first printed structure disposed on the first wall of the enclosure; and the second antenna element defines a second printed structure disposed on the second wall of the enclosure.

6. The hearing assistance device of claim 1, wherein the antenna comprises a stamped metal antenna or a flex circuit antenna.

7. The hearing assistance device of claim 1, wherein:

a spine is disposed in the enclosure; and the antenna is disposed on or supported by the spine.

8. The hearing assistance device of claim 1, further comprising at least one of:

a first insulator material disposed between the first section of the first feed arm and the first antenna element, or a second insulator material disposed between the second section of the second feed arm and the second antenna element.

9. The hearing assistance device of claim 1, wherein the first non-contacting electrical transmission line coupling and the second non-contacting electrical transmission line coupling are solderless couplings.

* * * * *